United States Patent [19]

Ishikawa

[11] 4,266,845

[45] May 12, 1981

[54] RESILIENT CONTACT MEMBER OF JACK FOR USE IN CONJUNCTION WITH A PIN-PLUG

[75] Inventor: Kazuhiro Ishikawa, Tomioka, Japan

[73] Assignee: Iizuka Electric Industry Company Limited, Gunma, Japan

[21] Appl. No.: 71,163

[22] Filed: Aug. 30, 1979

[51] Int. Cl.[3] ..... H01R 13/12

[52] U.S. Cl. ..... 339/258 R

[58] Field of Search ..... 339/176 MP, 182 R, 183, 339/258 R, 258 P

[56] References Cited

U.S. PATENT DOCUMENTS

| | | | |
|---|---|---|---|
| 3,107,319 | 10/1963 | Vizzier, Sr. | 339/258 P |
| 3,696,319 | 10/1972 | Olsson | 339/258 R |

FOREIGN PATENT DOCUMENTS

| | | | |
|---|---|---|---|
| 608333 | 9/1960 | Italy | 339/176 MP |
| 1013151 | 12/1965 | United Kingdom | 339/176 MP |

*Primary Examiner*—Neil Abrams

*Attorney, Agent, or Firm*—Lawrence I. Field

[57] ABSTRACT

A resilient contact member to be installed in a jack for use in conjunction with a pin-plug comprising a fixed leg portion to be fixed to an inner wall of a housing of the jack, a movable leg portion having a portion which is to be engaged with a pin portion of the pin-plug inserted into the jack to make an electrical connection between the jack and pin-plug, a substantially U-shaped portion for connecting the fixed and movable leg portions to each other at their one ends, said fixed and movable leg portions extending in parallel with each other, and a projection integrally formed with the fixed leg portion or the movable leg portion and extending toward the movable leg portion or the fixed leg portion. The projection has such a length that the movable leg portion could not be displaced beyond an elastic limit of the U-shaped portion. The fixed and movable leg portions, U-shaped portion and projection are all formed integrally with each other by punching a thin metal plate.

4 Claims, 10 Drawing Figures

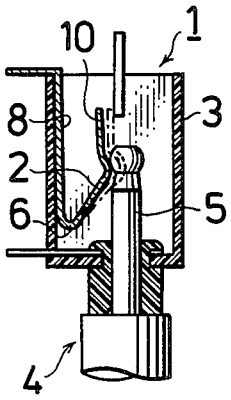
Fig.1
PRIOR ART
PRIOR ART
Fig.2a
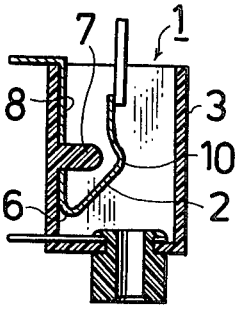
PRIOR ART
Fig.2b
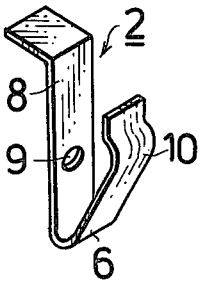
PRIOR ART
Fig.3a
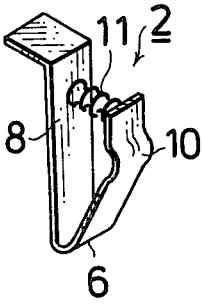
PRIOR ART
Fig.3b
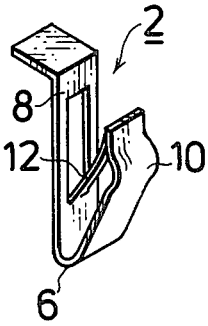
PRIOR ART
Fig.3c
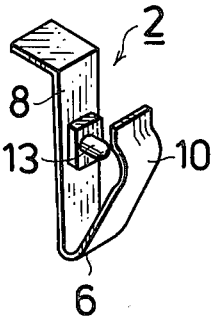
Fig.4a
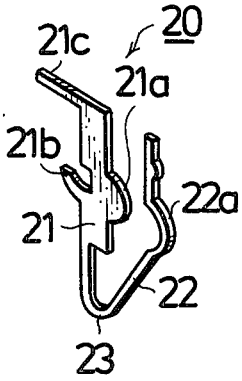
Fig.4b
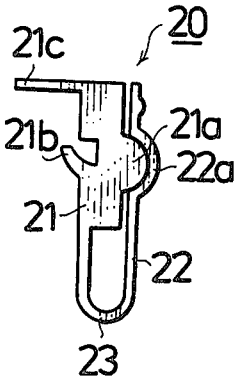

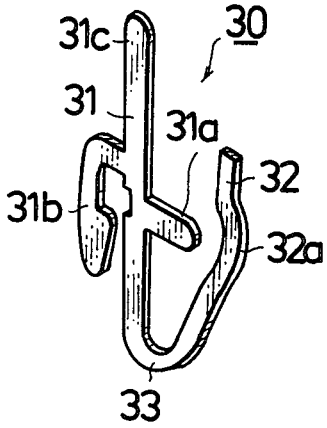
Fig.5
Fig.6
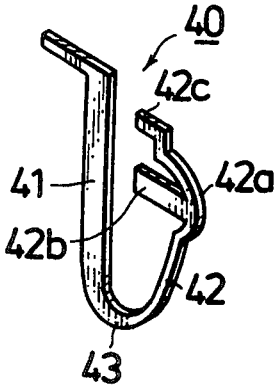

RESILIENT CONTACT MEMBER OF JACK FOR USE IN CONJUNCTION WITH A PIN-PLUG

BACKGROUND OF THE INVENTION

The present invention relates generally to an electrical jack for use in conjunction with a pin-plug, and more particularly to a resilient contact member which engages resiliently with a pin portion of the pin-plug inserted into the jack.

There have been proposed various kinds of jacks. FIG. 1 is a cross section showing an embodiment of one known jack. A jack 1 comprises a resilient contact member 2 which is secured to an inner wall of a housing 3. The contact member 2 is formed by bending a metal strip of a relatively large width into a substantially U-shaped form. The contact member 2 comprises a fixed leg portion 8 and a movable leg portion 10 connected to the leg portion 8 by means of a U-shaped bent portion 6. When a pin-plug 4 is inserted into the jack 1, the movable leg portion 10 is displaced from a position illustrated in FIG. 1 by a chain line due to an engagement of the movable leg portion 10 with a pin portion 5 of the plug 4. Each time the pin-plug 4 is inserted into and pulled out of the jack 1 the bent portion 6 of the contact member 2 is deformed and thus is fatigued. Therefore the resiliency or elasticity of the contact member 2 becomes gradually decreased. In an extreme case the bent portion 6 might be deformed beyound its elastic limit and could not return to its original position. In this manner a contact pressure of the contact member 2 with respect to the pin portion 5 becomes small and thus an electrical property of the pin-plug and jack connection is deteriorated to a great extent.

In order to avoid the above mentioned drawback of the known jack shown in FIG. 1 there have been devised several other jacks. FIG. 2*a* shows an embodiment of such a jack. In this jack 1 a projection 7 is formed on the inner wall of a housing 3 and a fixed leg portion 8 of contact member 2 is provided with a hole 9 as illustrated in FIG. 2*b*. As shown in FIG. 2*a* the contact member 2 is secured to the housing 3, while the projection 7 is inserted into the hole 9. The projection 7 has such a length that it can limit the displacement of the movable leg portion 10 of the contact member 2.

FIGS. 3*a*, 3*b* and 3*c* show other embodiments of the known contact member 2 of FIG. 2*b*. In the contact member of FIG. 3*a* between a fixed leg portion 8 and a movable leg portion 10 is inserted a coiled spring 11. In the embodiment illustrated in FIG. 3*b* a resilient lead like strip 12 is formed integrally with a fixed leg portion 8 and a free end of the strip is urged against a movable leg portion 10. In a contact member 2 shown in FIG. 3*c* a projection 13 made of insulating material is secured to a fixed leg portion 8.

The contact members illustrated in FIGS. 2 and 3 can overcome the disadvantage of the contact member shown in FIG. 1 and the movable leg portion 10 can be effectively prevented from being deformed beyond its elastic limit. However it is rather difficult to manufacture such contact members. It is apparent that the manufacture of such contact members requires at least one additional step. Particularly in case of a jack of small size the contact member could not be formed from a relatively wide metal strip, but has to be made of a thin metal strip such as a metal wire. In this case the above mentioned reinforcing means could not be applied at all.

SUMMARY OF THE INVENTION

The present invention has for its object to provide a novel and useful resilient contact member for use in a jack, which contact member can avoid the above mentioned drawback of the known contact members and has a projection for limiting an excessive displacement of a movable leg portion in a very simple manner without any additional manufacturing step.

It is another object of the invention to provide a contact member which can be advantageously installed in a jack of a small size.

According to the invention a contact member of a jack for use in conjunction with a pin-plug comprises a fixed leg portion for securing the contact member to a housing of the jack; a movable leg portion extending substantially in parallel with the fixed leg portion; a substantially U-shaped portion for coupling the fixed and movable leg portions with each other at their one ends; and at least one projection formed integrally with one of the fixed and movable leg portions and extending toward the other leg portion, the projection having such a length that a displacement of the movable leg portion toward the fixed leg portion can be limited by an engagement of the projection with the leg portion, wherein said fixed leg portion, movable leg portion, U-shaped portion and projection are all integrally formed by punching a metal plate.

BRIEF DESCRIPTION OF THE DRAWINGS

FIG. 1 is a cross section showing a connection of a pin-plug and a jack having a known contact member;

FIG. 2*a* is a cross section of another known jack and FIG. 2*b* is a perspective view illustrating the contact member of FIG. 2*a;*

FIGS. 3*a*, 3*b* and 3*c* are perspective views showing other embodiments of known contact members having means for limiting an excessive displacement of a movable leg portion;

FIGS. 4*a* and 4*b* are perspective and plan views, respectively showing an embodiment of a contact member according to the invention; and FIGS. 5 and 6 are perspective views illustrating other embodiments of a contact member according to the invention.

DESCRIPTION OF THE PREFERRED EMBODIMENTS

FIGS. 4*a* and 4*b* show a first embodiment of a resilient contact member of a jack according to the present invention. The contact member of the invention can be easily manufactured by punching a thin metal plate having a thickness of, for example, 0.5 mm by means of a pressing machine. FIG. 4*a* shows the contact member 20 in a free condition, i.e. in such a condition that it does not engage with a pin-plug. The contact member 20 comprises a fixed leg portion 21, a movable leg portion 22 and a U-shaped portion 23 for coupling the leg portions 21 and 22 with each other. The movable leg portion 22 has formed therein a semicircularly bent portion 22*a* which is resiliently engaged with the top of the pin portion 5 of the pin-plug 4 shown in FIG. 1. The fixed leg portion 21 has formed integrally therewith a semicircular sector projection 21*a*. As shown in FIG. 4*b* these semicircular portions 21*a* and 22*a* have corresponding contour configurations and thus the projection 21*a* can serve as a stop for limiting the displacement of the movable leg portion 22 beyond its elastic limit.

Further the fixed leg portion 21 has formed therein a small projection 21*b* for securing the contact member 20 to the housing of the jack and a terminal portion 21*c* for connecting a lead wire to the contact member 20.

FIG. 5 is a perspective view illustrating another embodiment of the resilient contact member according to the invention. The contact member 30 of this embodiment is similar to the previous embodiment shown in FIGS. 4*a* and 4*b* except that a fixed leg portion 31 has formed integrally therewith a rod-shaped projection 31*a* which extends toward a semicircularly bent portion 32*a* of a movable leg portion 32 connected to the fixed leg portion 31 by means of a U-shaped portion 33. As shown in FIG. 5 the fixed leg portion 31 has formed therein a projection 31*b* for securing the contact member 30 to the housing of a jack and a terminal portion 31*c* for connecting a lead wire to the jack. This contact member 30 can be simply manufactured by punching a thin metal plate.

FIG. 6 is a perspective view showing still another embodiment of the contact member according to the invention. A contact member 40 of this embodiment comprises a fixed leg portion 41 and a movable leg portion 42 coupled to the fixed leg portion 41 by means of a U-shaped portion 43. In this embodiment a rod-shaped projection 42*b* is integrally formed with a semicircularlly bent portion 42*a* of the movable leg portion 42. At a free end of the movable leg portion 42 there is integrally formed therewith a second projection 42*c*. These projections 42*b* and 42*c* extend toward the fixed leg portion 41 and thus serve as stops for limiting the displacement of the movable leg portion 42 beyond the elastic limit of the U-shaped portion 43. The contact member 40 of this embodiment can be also formed by simply punching a thin metal plate.

When the contact member according to the invention is installed in a housing of a jack for use in conjunction with a pin-plug and a pin portion of the pin-plug is inserted into the jack, the movable leg portion 22, 32 or 42 is displaced toward the fixed leg portion 21, 31 or 41 by means of an engagement of the semicircularly bent portion 22*a*, 32*a* or 42*a* of the movable leg portion with a pin portion of the pin-plug. However the displacement of the movable leg portion is limited by the engagement of the projection 21*a*, 31*a* or 42*b* and 42*c* with the movable leg portion or the fixed leg portion. Therefore the movable leg portion could not be displaced more than a certain amount and thus the U-shaped portion 23, 33 or 43 could not be deformed beyond its elastic limit. Further a contact pressure between the movable leg portion and the pin portion of the pin-plug can be maintained to be a sufficiently high value for a very long time and thus the electrical property of the pin-plug and jack connection can be improved to a great extent. Moreover since the contact member according to the invention is formed by punching a thin metal plate into a desired shape the rigidity of the U-shaped portion 23; 33 or 43 is very high and thus the contact pressure is further increased. Therefore the pin-plug is hardly drawn out of the jack. Further the contact member according to the invention can be easily manufactured by a single punching operation, so that any additional manufacturing step is not required.

What is claimed is:

1. A resilient contact member of an electrical jack for use in conjunction with a pin-plug comprising:

a fixed leg portion for securing the contact member to a housing of the jack;

a movable leg portion extending substantially in parallel with a fixed leg portion and including a semicircularly bent portion projecting in a direction opposite to the fixed leg portion;

a substantially U-shaped portion for coupling one end of the fixed and one end of the movable leg portions with each other; and a projection extending from the fixed leg portion toward the semicircularly bent portion of the movable leg portion and having such a length that an excessive deformation of the movable leg portion can be prevented by an engagement of a free end of the projection with the semicircularly bent portion of the movable leg portion; wherein said fixed leg portion, movable leg portion, U-shaped portion and projection are integrally formed by punching a metal plate and said movable leg portion is resiliently bent in a plane of the metal plate.

2. A resilient contact member according to claim 1, wherein said projection is formed as a semicircular sector which has a contour corresponding to that of the semicircularly bent portion.

3. A resilient contact member of an electrical jack for use in conjunction with a pin-plug comprising:

a fixed leg portion for securing the contact member to a housing of the jack;

a movable leg portion extending substantially in parallel with the fixed leg portion and including a semicircularly bent portion projecting in a direction opposite to the fixed leg portion;

a substantially U-shaped portion for coupling one end of the fixed and one end of the movable leg portions with each other; and a projection extending from the semicircularly bent portion of the movable leg portion toward the fixed leg portion and having such a length that an excessive deformation of the movable leg portion can be prevented by an engagement of the free end of the projection with the fixed leg portion; wherein said fixed leg portion, movable leg portion, U-shaped portion and projection are integrally formed by punching a metal plate and said movable leg portion is resiliently bent in a plane of the metal plate.

4. A resilient contact member according to any of claims 1 and 3, wherein said projection is formed as a rod-like strip which extends substantially in parallel with a direction of the deformation of the movable leg portion.

* * * * *